US010939760B2

(12) United States Patent
Zhao et al.

(10) Patent No.: US 10,939,760 B2
(45) Date of Patent: Mar. 9, 2021

(54) SUPPORT FOR WASHING MACHINE WITH AUTOMATIC LEVELING FUNCTION AND WASHING MACHINE

(71) Applicants: QINGDAO HAIER WASHING MACHINE CO., LTD., Shandong (CN); QINGDAO HAIER SMART TECHNOLOGY R&D CO., LTD., Shandong (CN)

(72) Inventors: Zhiqiang Zhao, Shandong (CN); Sheng Xu, Shandong (CN)

(73) Assignees: QINGDAO HAIER WASHING MACHINE CO., LTD., Shandong (CN); QINGDAO HAIER SMART TECHNOLOGY R&D CO., LTD., Shandong (CN)

( * ) Notice: Subject to any disclaimer, the term of this patent is extended or adjusted under 35 U.S.C. 154(b) by 116 days.

(21) Appl. No.: 16/325,227

(22) PCT Filed: Jun. 29, 2017

(86) PCT No.: PCT/CN2017/090838
§ 371 (c)(1),
(2) Date: Feb. 13, 2019

(87) PCT Pub. No.: WO2018/032886
PCT Pub. Date: Feb. 22, 2018

(65) Prior Publication Data

US 2019/0200760 A1 Jul. 4, 2019

(30) Foreign Application Priority Data

Aug. 16, 2016 (CN) ..... 201610679111.9

(51) Int. Cl.
*A47B 91/16* (2006.01)
*D06F 39/12* (2006.01)

(52) U.S. Cl.
CPC ..... *A47B 91/16* (2013.01); *D06F 39/12* (2013.01); *D06F 39/125* (2013.01)

(58) Field of Classification Search
CPC ..... A47B 91/16; A47B 91/10; E06F 39/12; D06F 3/125; F16M 7/00; F16M 2200/044;
(Continued)

(56) References Cited

U.S. PATENT DOCUMENTS 3,667,707 A * 6/1972 Mui ..... F16F 15/0275 248/550
3,768,766 A 10/1973 Bain
(Continued)

FOREIGN PATENT DOCUMENTS

CH 695348 A5 4/2006
CN 105755750 A 7/2016
(Continued)

OTHER PUBLICATIONS

International Search Report (PCT/ISA/210) dated Sep. 26, 2017, by the State Intellectual Property Office of the P.R. China as the International Searching Authority for International Application No. PCT/CN2017/090836.
(Continued)

*Primary Examiner* — Christopher Garft
(74) *Attorney, Agent, or Firm* — Buchanan Ingersoll & Rooney PC

(57) ABSTRACT

A support for washing machine with automatic leveling function comprises: a sheath; a regulating mechanism, arranged in the sheath and axially movable relative to the sheath; and a flexible body assembly, which is arranged in the regulating mechanism and accommodates a hydraulic medium; one end of the flexible body assembly is limited and arranged in the sheath, another end is a stretchable end
(Continued)

which acts on the regulating mechanism, the stretchable end expands and contracts under the action of the hydraulic medium and drives the regulating mechanism to move axially for automatic leveling. The flexible body assembly comprises a flexible accommodating body, a mounting, and a protection mechanism between the mounting assembly and the flexible accommodating body. The flexible body assembly is arranged in the sheath to avoid any damage, and the arrangement of the protection mechanism avoids the flexible accommodating body from directly contacting with the mounting assembly.

12 Claims, 6 Drawing Sheets

(58) Field of Classification Search
CPC ..... F16M 2200/08; F16M 11/26; A47L 15/4253; A47L 391/10; F16F 9/165; F16F 15/366; E06C 7/426; F16B 15/262
USPC ..... 248/188.5, 188.3
See application file for complete search history.

(56) References Cited

U.S. PATENT DOCUMENTS

| | | | | |
|---|---|---|---|---|
| 4,317,472 | A | 3/1982 | Zahid | |
| 4,625,424 | A * | 12/1986 | de la Haye | G12B 5/00 248/649 |
| 9,909,709 | B2 | 3/2018 | Pike et al. | |
| 2006/0180720 | A1 * | 8/2006 | Coumoyer | D06F 39/125 248/188.2 |
| 2016/0025261 | A1 | 1/2016 | Pike et al. | |
| 2017/0258228 | A1 | 9/2017 | Kato | |
| 2018/0187362 | A1 | 7/2018 | Zhao et al. | |
| 2018/0195227 | A1 | 7/2018 | Zhao et al. | |
| 2018/0202095 | A1 | 7/2018 | Zhao et al. | |

FOREIGN PATENT DOCUMENTS

| | | | |
|---|---|---|---|
| CN | 105755757 | A | 7/2016 |
| CN | 105757408 | A | 7/2016 |
| CN | 205775399 | U | 12/2016 |
| DE | 10156397 | A1 | 5/2003 |
| WO | 2016/088529 | A1 | 6/2016 |

OTHER PUBLICATIONS

Written Opinion (PCT/ISA/237) dated Sep. 21, 2017, by the State Intellectual Property Office of the P.R. China as the International Searching Authority for International Application No. PCT/CN2017/090838.

Office Action dated May 21, 2020 by the U.S. Patent and Trademark Office in U.S. Appl. No. 16/325,069, (14 pages).

Extended European Search Report dated Aug. 13, 2019, issued by the European Patent Office in European Application No. 17840862.1. (7 pages).

* cited by examiner

SUPPORT FOR WASHING MACHINE WITH AUTOMATIC LEVELING FUNCTION AND WASHING MACHINE

TECHNICAL FIELD

The present disclosure relates to a technical field of washing machines, and specifically relates to a support for washing machine, and a washing machine.

BACKGROUND

Generally, leveling devices are arranged at bottoms of shells of the household appliances, the household appliances can achieve a stable placed state through regulating the leveling devices when the household appliances are placed, and the leveling devices can support the household appliances and keep the household appliances stable after the household appliances are placed in a leveled manner.

Taking a washing machine for example, bolt supports are generally mounted at the bottom of a shell or whole set of the existing washing machine, each bolt support comprises a lead screw, a nut gasket and a rubber pad. The nut gaskets can be screwed up and down on the lead screws, the lead screws can also be screwed up and down in screw holes of a bottom plate of the shell, and the height regulating of the washing machine is achieved through lengths of the lead screws of the bolt supports screwed in the screw holes of the bottom plate; for a majority of washing machines, heights are increased through counterclockwise rotation of the supports, the heights are reduced through clockwise rotation of the supports; and after the heights of the bolt supports are regulated, the nut gaskets for preventing loosening are screwed down to keep steadiness.

For the supports of the washing machine, although the leveling of the washing machine is achieved, users are required to carry out manual regulation, and user operation is extremely inconvenient if the dead weight of the washing machine is relatively heavy or a setting space is narrow and small. In addition, during the long-term working of the washing machine, vibration also acts on the leveling supports, the supporting failure of the leveling supports is easily caused, and thus, the out-of-flat placement of the washing machine is caused.

For example, the existing 8 KG drum washing machine is generally about 80 Kg and is relatively heavy, the regulation by customers is extremely inconvenient, the condition that the washing machine is regulated to an optimum state cannot be guaranteed even if the regulation is completed. During the washing, particularly spin-drying dewatering of acceleration to 1400 r/min from 0 r/min of the washing machine, great vibration will be caused once the washing machine is not horizontal or suffers from a failure of support problem, and thus, the comfort of use of the customers is greatly affected.

In addition, the vibration caused by the out-of-flat of the washing machine may loosen screws of the supports, supporting brackets of the supports may vertically move, a horizontal state of the washing machine may be changed by the instability, and vibration that is more intensive is caused. Due to the vicious cycle, the noise of the washing machine will become louder and louder in long-time use, certain damage to the washing machine is caused, and the service life of the washing machine is shortened.

Therefore, the leveling of the existing washing machines has the problems of manual regulation, time and labor consuming and relatively poor accuracy.

Taking this into consideration, the present disclosure is provided.

SUMMARY

In order to solve the above problems, a first disclosure object of the present disclosure is to provide a support for washing machine with automatic leveling function, and concretely, a technical scheme as follows is adopted:

A support for washing machine with automatic leveling function comprises:

a sheath;

a regulating mechanism, which is arranged in the sheath and is axially movable relative to the sheath; and a flexible body assembly, which is arranged in the regulating mechanism and accommodates a hydraulic medium;

one end of the flexible body assembly is limited and arranged in the sheath, another end is a stretchable end which acts on the regulating mechanism, the stretchable end expands and contracts under the action of the hydraulic medium and drives the regulating mechanism to move axially for automatic leveling.

The flexible body assembly comprises a flexible accommodating body, a mounting assembly for mounting the flexible accommodating body, and a protection mechanism provided between the mounting assembly and the flexible accommodating body for protecting the flexible accommodating body.

Further, the flexible accommodating body comprises a telescopic corrugation structure, a throttling fine diameter part and an opening, the opening is mounting on the mounting assembly in a sealed manner;

the protection mechanism is an upper protection ring and the upper protection ring sleeves on the throttling fine diameter part, an upper end surface of the upper protection ring is limited below the mounting assembly, a lower end surface is provided with a curved surface matched with the corrugation structure.

Further, the upper protection ring comprises a ring-shaped annular body and a mounting hole at the center of the annular body for the throttling fine diameter part going through;

the annular body is provided with a mounting groove penetrating the mounting hole, a width of the mounting groove is smaller than the outer diameter of the throttling fine diameter part.

the throttling fine diameter part deforms under pressure, and then enters the mounting hole through the mounting groove.

Further, a chamfering structure is provided at an opening, facing the outside of the annular body, of the mounting groove.

Further, a vertically-through limiting hole is formed on the upper protection ring, and a limiting protrusion used for being matched with the limiting hole is arranged on the mounting assembly.

Further, a limiting column is arranged on the mounting assembly, and the limiting column is arranged corresponding to the mounting groove of the upper protection ring.

Further, the mounting assembly comprises a hydraulic plate and a pressing plate, the opening of the flexible accommodating body is hermetically connected to the lower wall of the hydraulic plate through a pressing plate.

An oil nozzle is arranged on one side of the hydraulic plate, an oil hole used for enabling the hydraulic medium in the oil bag to flow into is formed in the lower wall of the hydraulic plate, an oil passage communicated with the oil nozzle and the oil hole is arranged in the hydraulic plate.

The lower end surface of the pressing plate abuts against the upper end surface of the protection mechanism.

Further, the limiting protrusion is provided on the lower end surface of the pressing plate.

Further, the limiting column is provided on the lower end surface of the pressing plate, and is located at two ends of the same diameter with the limiting protrusion.

A second disclosure object of the present disclosure is to provide a washing machine, concretely, which is adopted the technical schemes below:

A washing machine with the support for washing machine with automatic leveling function comprises a shell, the bottom of the shell is provided with a plurality of supports for washing machine mentioned above, the hydraulic medium provided in the supports for washing machine can flow among them and level them.

According to the support for washing machine with automatic leveling function, provided by the present disclosure, based on the hydraulic principle, the support is filled with hydraulic medium, the support can perform adaptive regulation automatically by means of the fluidity of the hydraulic medium for different pressures.

According to the support for washing machine with automatic leveling function, provided by the present disclosure, the hydraulic medium is contained inside the sealed flexible body assembly, and the flexible body assembly is disposed in the regulating mechanism. Thus, it effectively solves the problem of leakage of the hydraulic medium and ensures the stability of the operation of the supports.

According to the support for washing machine with automatic leveling function, provided by the present disclosure, the flexible body assembly is limited and arranged in the sheath to avoid any damage to the flexible body assembly, so as to ensure the stability of the operation of the flexible body assembly. In addition, the arrangement of the protection mechanism avoids the flexible accommodating body from directly contacting with the mounting assembly which greatly reduces the chance of breakage of the flexible accommodating body and extends the service life.

Therefore, the support for washing machine of the present disclosure has a simple structure with a lower production cost, is easy to use with high reliability, and greatly reduces vibration and noise. Thus, the comfort of the user experienced of the washing machine is improved.

Figure 1:
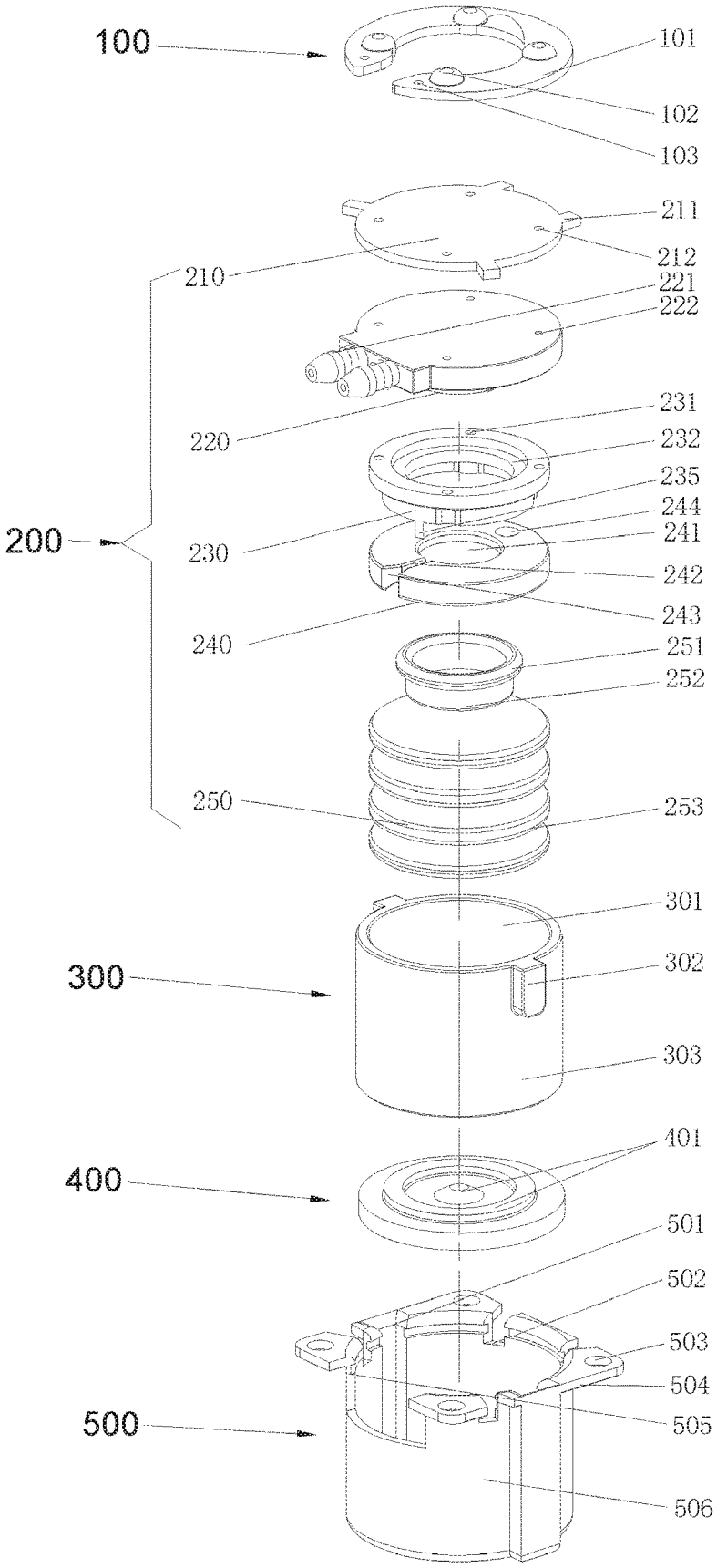
FIG. 1 is exploded view I of the support for washing machine with automatic leveling function in an embodiment of the present disclosure.
Figure 2:
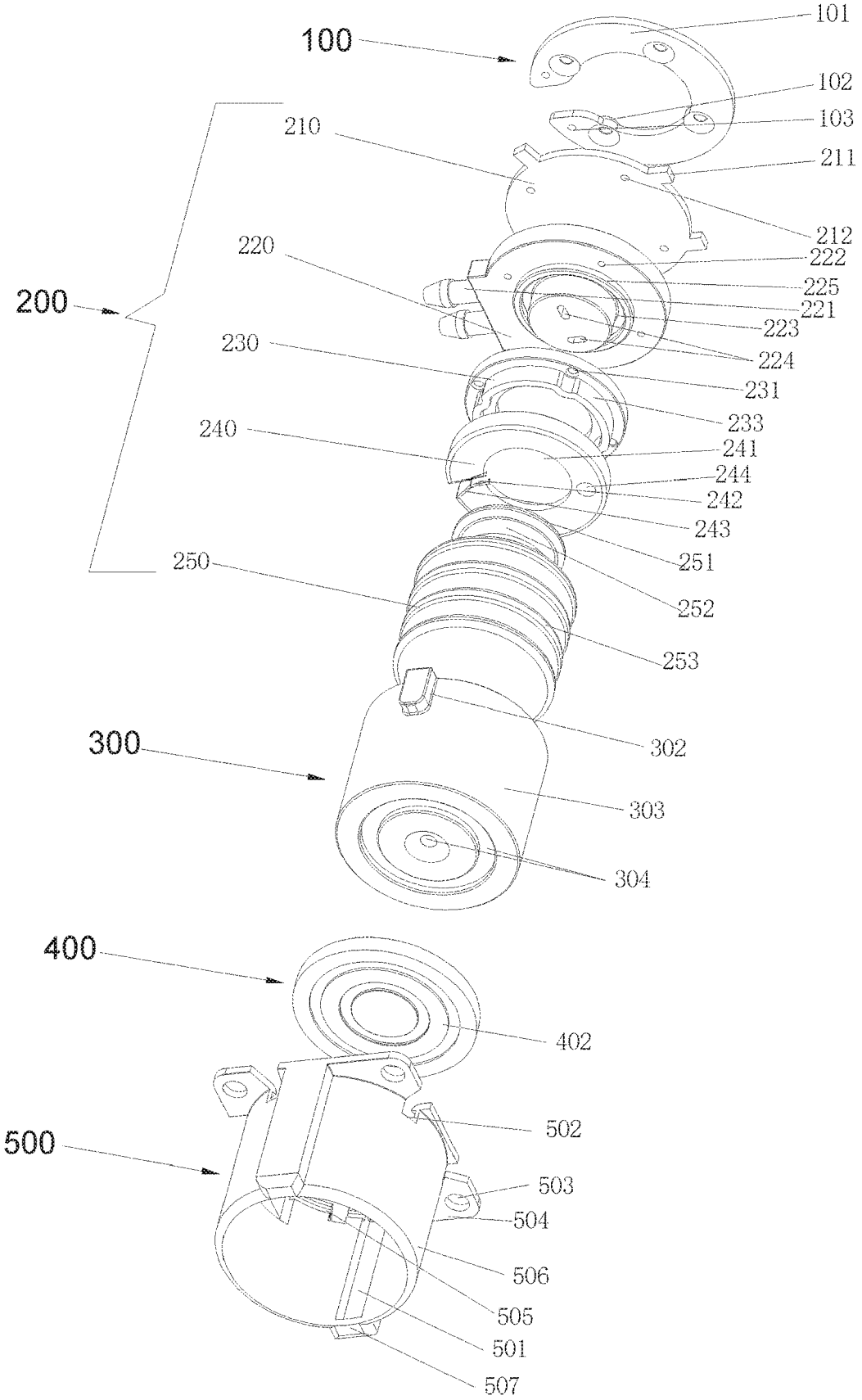
FIG. 2 is exploded view II of the support for washing machine with automatic leveling function in an embodiment of the present disclosure.
Figure 3:
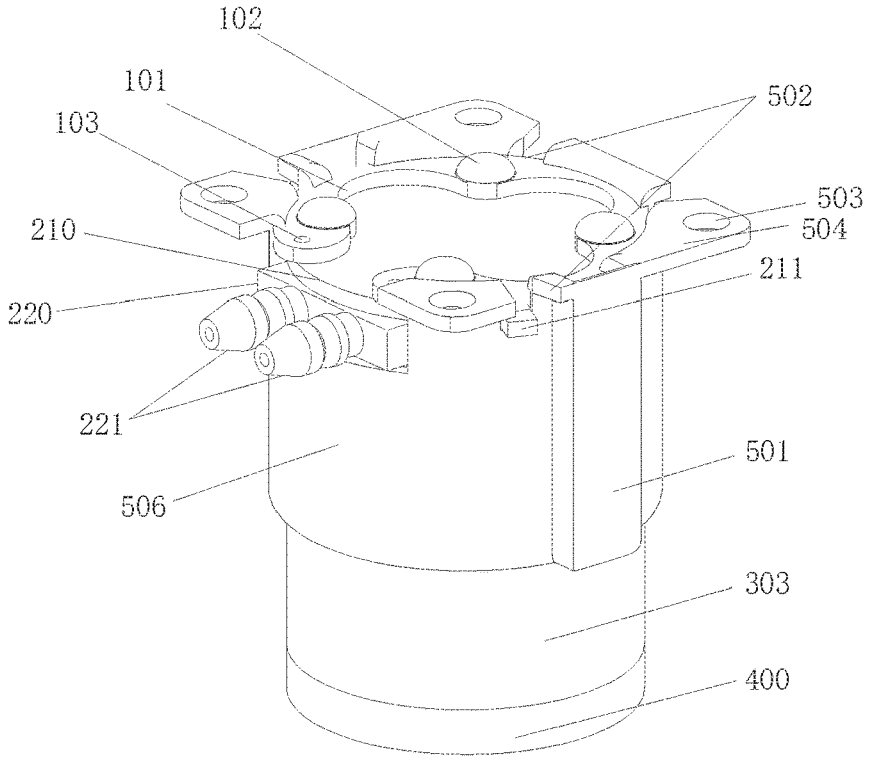
FIG. 3 is a three-dimensional structural schematic diagram of the support for washing machine with automatic leveling function in an embodiment of the present disclosure.
Figure 4:
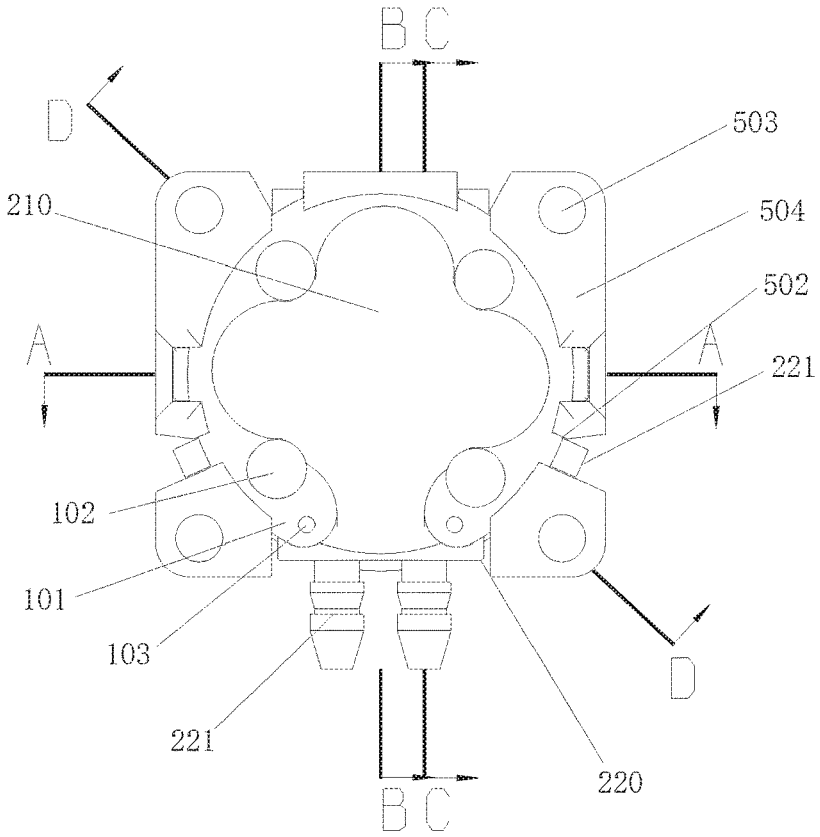
FIG. 4 is a top view of the support for washing machine with automatic leveling function in an embodiment of the present disclosure.
Figure 5:
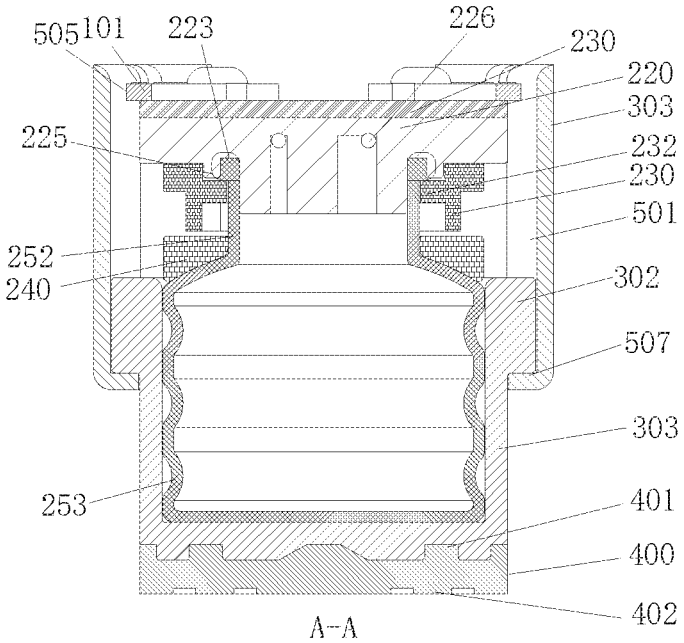
FIG. 5 is a sectional view of the support for washing machine with automatic leveling function in an embodiment of the present disclosure along a plane A-A in the FIG. 4.
Figure 6:
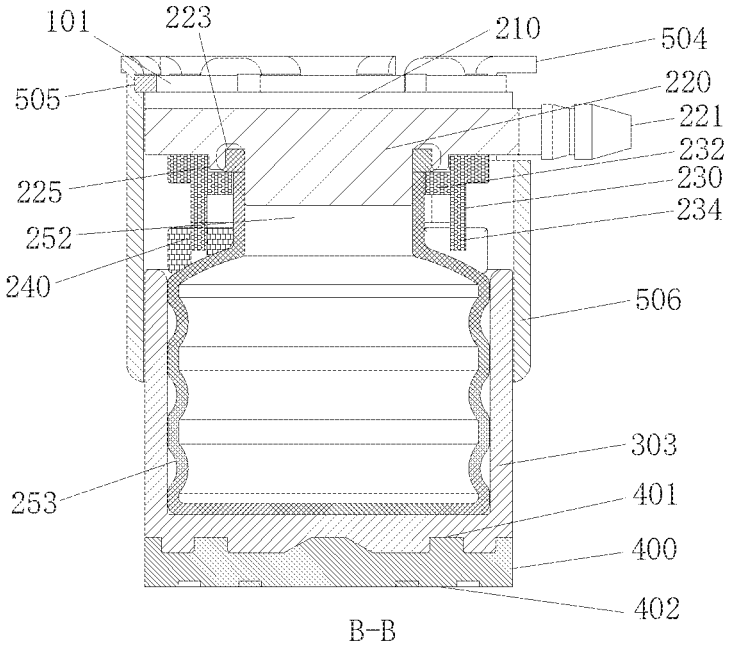
FIG. 6 is a sectional view of the support for washing machine with automatic leveling function in an embodiment of the present disclosure along a plane B-B in the FIG. 4.
Figure 7:
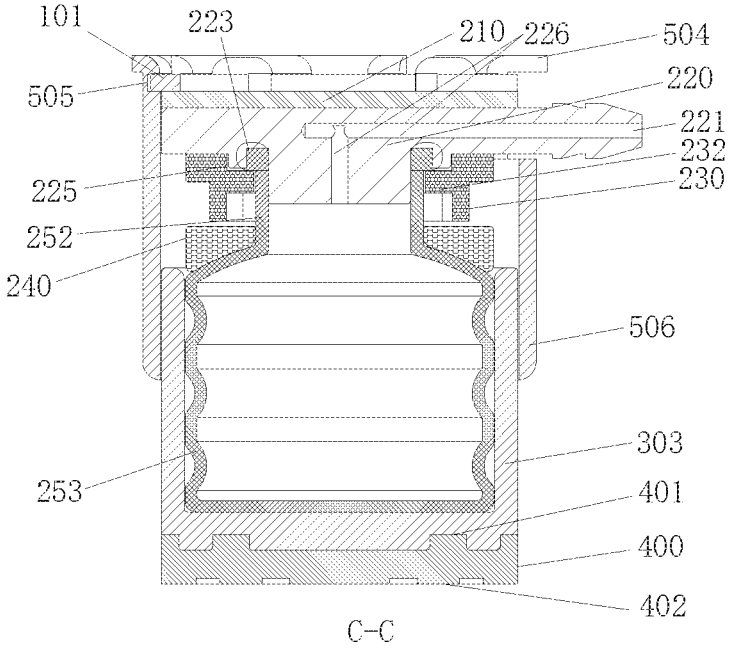
FIG. 7 is a sectional view of the support for washing machine with automatic leveling function in an embodiment of the present disclosure along a plane C-C in the FIG. 4.
Figure 8:
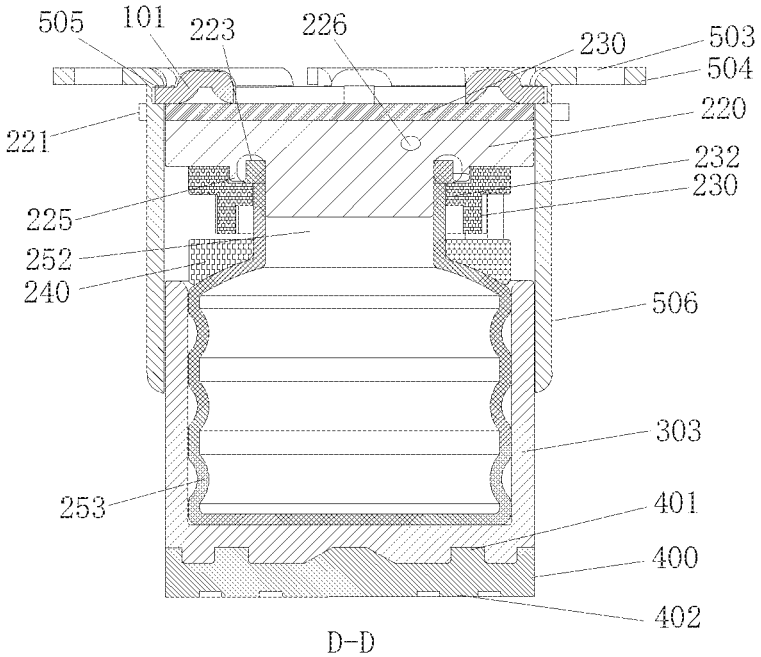
FIG. 8 is a sectional view of the support for washing machine with automatic leveling function in an embodiment of the present disclosure along a plane D-D in the FIG. 4.
Figure 9:
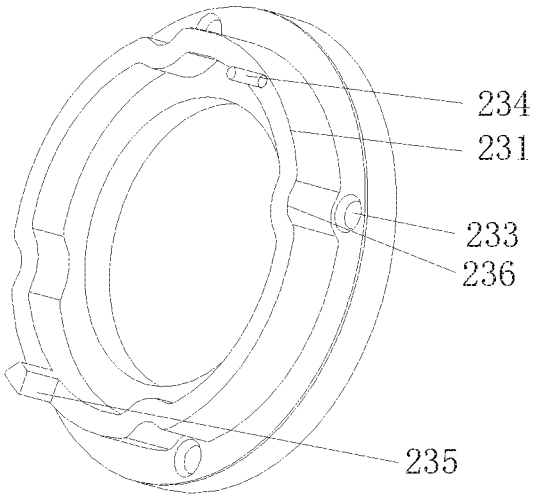
FIG. 9 is a three-dimensional structural schematic diagram of a pressing plate of the support for washing machine with automatic leveling function in an embodiment of the present disclosure.
Figure 10:
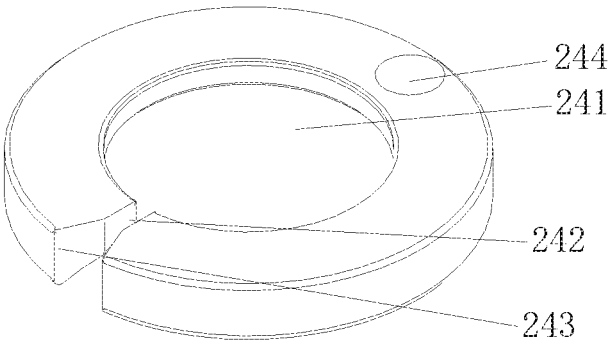
FIG. 10 is a three-dimensional structural schematic diagram I of a protection plate of the support for washing machine with automatic leveling function in an embodiment of the present disclosure.
Figure 11:
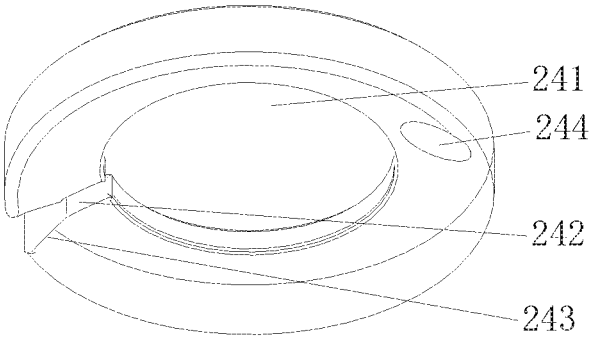
FIG. 11 is a three-dimensional structural schematic diagram II of the protection plate of the support for washing machine with automatic leveling function in an embodiment of the present disclosure.

Reference Signs: 100—axial limiting device, 101—clamp spring, 102—limiting protrusion, 103—hole, 200—flexible body assembly, 210—limiting plate, 211—limiting claw, 212—limiting plate mounting hole, 220—hydraulic plate, 221—oil nozzle, 222—hydraulic plate mounting hole, 223—sealing groove, 224—oil hole, 225—sealing rib, 226—oil passage, 230—pressing plate, 231—pressing plate mounting hole, 232—sealing pressing step, 233—lower ring of pressing plate, 234—positioning column, 235—positioning protrusion, 240—upper protection ring, 241—mounting hole, 242—mounting groove, 243—chamfering structure, 244—limiting hole, 250—oil bag, 251—opening, 252—throttling fine diameter part, 253—corrugation structure, 300—regulating mechanism, 301—hollow cavity, 302—guiding limiting block, 303—barrel, 400—elastic gasket, 401—reinforcing fitting rib, 402—damping rib, 500—sheath, 501—guiding limiting groove, 502—limiting groove, 503—sheath fixing hole, 504—sheath plane, 505—annular groove, 506—sleeve body, 507—stopping part, 600—ground, 601—ground pit, 700—high-pressure oil pipe, 800—support for washing machine

DETAILED DESCRIPTION

A support for washing machine with automatic leveling function and a washing machine provided by the present disclosure are described in detail below with reference to accompanying drawings.

Embodiment I

As shown in Figs from 1 to 8, the support for washing machine with automatic leveling function in the present embodiment comprises:

a sheath 500;

a regulating mechanism 300, which is arranged in the sheath 500 and is axially movable relative to the sheath; and a flexible body assembly 200, which is arranged in the regulating mechanism 300 and accommodates a hydraulic medium;

one end of the flexible body assembly 200 is limited and arranged in the sheath 500, another end is a stretchable end which acts on the regulating mechanism 300;

the stretchable end of the flexible body assemble 200 expands and contracts under the action of the hydraulic medium and drives the regulating mechanism 300 to move axially for automatic leveling.

The supports for washing machine provided in the present embodiment are arranged on the four corners of a bottom plate of the washing machine or are uniformly provided with at least four along the circumferential direction of the bottom plate; at least two of the supports for washing machine are communicated with each other. When a washing machine is on an uneven ground, the force on each support for washing machine is different and the hydraulic medium in the supports which are communicated with each other flows from the support with larger force to the support with smaller force. With the circulation of the hydraulic medium, the flexible body assembly 200 expands and contracts, further driving the regulating mechanism 300 to move axially to achieve automatic leveling.

The supports for washing machine provided in the present embodiment are communicated with each other so that the hydraulic medium inside the supports for washing machine can communicate among them. When one of the supports for washing machine is compressed, the hydraulic medium circulates to another support for washing machine that is in communication with it, and the hydraulic medium in the other support for washing machine increases, and the pressure increases to extend the support to ensure sufficient supporting force.

According to the support for washing machine with automatic leveling function in the present embodiment, the flexible body assembly 200 is limited and mounted in the sheath 500 to avoid any damage causing to the flexible body assembly 200, which ensures the stability of the operation of the flexible body assembly 200.

In addition, the support for washing machine with automatic leveling function in the present embodiment is high in assembling efficiency, simple, and convenient to use. The force receiving component (such as the sheath 500) can be made of sheet metal, or be cast by zinc alloy, or be injected by high-performance engineering plastics such as PPS, PI, PEEK, etc., with high reliability.

The support for washing machine with automatic leveling function in the present embodiment provides an optimized structure, which is simple to assemble, is easy to install, and avoids the flexible body assembly 200 from being damaged as much as possible to ensure the overall stability of the support for washing machine, and prolongs the service life.

Specifically, the sheath 500 according to the present embodiment comprises a sleeve body 506 having a hollow channel inside, and the regulating mechanism 300 is axially slidably disposed in the hollow channel of the sleeve body 506. And one end of the regulating mechanism extends out of the sleeve body 506 for contacting with the ground, and the regulating mechanism moves axially under the action of the hydraulic medium according to the height of the ground for automatically leveling.

In the present embodiment, one end opening of the sleeve body 506, flanging extends to the outer side of the hollow channel to form a sheath plane 504. The sheath plane 504 is attached to the bottom plate of the washing machine and fixedly connected by a connector. The sleeve body 506 of this embodiment is fixedly installed on the bottom plate of the washing machine through the sheath plane 504, and the flexible body assembly 200 is disposed in the sheath 500. In this way, the sheath 500 interacts with the bottom plate, and the flexible body assembly 200 does not receive the force of the washing machine, and only expands and contracts under the action of the hydraulic medium to ensure the stability of the work.

The sleeve body 506 of this embodiment is of a cylindrical structure, and has a certain length to cooperate with the regulating mechanism 300 to wrap at least part of the regulating mechanism 300.

The upper part of the sleeve body 506 of the present embodiment has a punched and integrally formed a flanging structure, forming the sheath plane 504. The sheath plane 504 is provided with a sheath fixing hole 503, so that the sheath 500 and even the entire support for washing machine can be tightly fixed on the bottom plate of the washing machine by screws or bolts.

Preferably, the sheath 500 of this embodiment can be selected from plastic injection molding, aluminum alloy die casting, etc., and is preferably produced by sheet metal stamping.

The flexible body assembly 200 of the present embodiment comprises an hydraulic plate 220, a pressing plate 230 and an oil bag 250, an opening of the oil bag 250 is hermetically connected to the lower wall of the hydraulic plate 220 through the pressing plate 230.

In the present embodiment, an oil nozzle 221 is provided on one side of the hydraulic plate 220. A lower wall of the hydraulic plate 220 is provided with an oil hole 224 through which the hydraulic medium in the oil bag 250 flows in. An oil passage 226 communicating with the oil nozzle 221 and the oil hole 224 is provided in the hydraulic plate 220.

The hydraulic plate 220 of the present embodiment is limited and mounted at one end of the sheath plane 504 of the sleeve body 506. The oil bag 250 is disposed within the sheath 500 and is in contact with the inner wall thereof.

The components of the hydraulic plate 220 of the present embodiment that are integrally injection-molded or die-casted have at least two oil nozzles 221 on thereof for mutual communication between the supports for washing machine so that the hydraulic medium is circulated between the supports for washing machine.

The hydraulic plate 220 of the present embodiment has an oil hole 224 at an intermediate position and an oil passage 226 inside to ensure that the hydraulic medium inside the oil bag 250 can flow through the oil hole 224 to the oil nozzle 221 through the oil passage 226, and thus the hydraulic medium in multiple supports for washing machine flows freely according to the size of the pressure the support received to realize the automatic leveling.

The oil bag 250 of this embodiment contains the hydraulic medium, and the hydraulic plate 220 seals the hydraulic medium of the oil bag 250 and causes the hydraulic medium in the oil bag 250 to flow out/into from the oil nozzle 221 of the hydraulic plate 220. The pressing plate 230 is used to ensure the sealed connection between the opening of the oil bag 250 and the hydraulic plate 220 so as to prevent the leakage of the hydraulic medium.

The oil bag 250 of the flexible body assembly 200 of the present embodiment is a stretchable structure made of a flexible material. Preferably, the flexible material has elasticity and can achieve deformation recovery. The hydraulic plate 220 is an integral injection-molded or die-cast formed component. Therefore, only the hydraulic plate 220 needs to be limit mounted in the sleeve body 506 to achieve the limit installation of the flexible body assembly 200.

In the present embodiment, in order to implement the limit installation of the flexible body assembly 200, it is mainly necessary to limit the circumferential rotational motion and the axial up and down motion of the flexible body assembly 200. In order to limit the circumferential rotational motion of the flexible body assembly 200, specifically:

The flexible body assembly 200 of the present embodiment further includes a limiting plate 210. The limiting plate 210 includes a plurality of limiting claws 211 which are protruded provided, and the sleeve body 506 is provided with limiting grooves 502 correspondingly for limiting the limiting claws. The limiting plate 210, the hydraulic plate 220, and the pressing plate 230 are fixedly connected to limit the circumferential rotation of the flexible body assembly 200 disposed in the regulating mechanism 300.

In the flexible body assembly 200 of the present embodiment, the limiting claw 211 of the limiting plate 210 cooperates with the limiting groove 502 of the sleeve body 506 so that the flexible body assembly 200 cannot rotate in the circumferential direction.

The limiting plate 210 of the present embodiment includes a plurality of limiting claws 211, which are provided according to the specific structure and installation of the hydraulic plate 220.

Specifically, the sleeve body 506 is provided with an opening for the oil nozzle 221 of the hydraulic plate 220 to stretch out. Therefore, when the limit claw 211 is provided, the position of the opening needs to be considered, and the opening is avoided to ensure the limit installation.

The limiting plate 210 of the present embodiment is provided with a limiting plate mounting hole 212, the hydraulic plate 220 has an hydraulic plate mounting hole 222, the pressing plate 230 is provided with a pressing plate mounting hole 231, and, the pressing plate 230, the hydraulic plate 220 and the limiting plate 210 are tightly fixed together by screw or bolt.

The sheath 500 of the present embodiment is mounted on the bottom plate of the washing machine, the hydraulic plate 220 is tightly fixed to the limiting plate 210. The upper and lower ends of the limiting plate 210 are both limited, the lower end is the lowest end of the limiting groove 502 of the sheath 500, and the limiting claw 211 and the limiting groove 502 at least make the limiting plate 210 have a forced supporting point in the circumferential direction. That is, the limiting claw 211 and the limiting groove 502 are distributed as evenly as possible in the circumferential direction.

Preferably, the limiting plate 210 is made of sheet metal stamping, which is simple and low cost The support for washing machine of the present embodiment, in order to limit the rotational movement of the flexible body assembly 200 in the circumferential direction, specifically:

The support for washing machine in this embodiment further includes an axial limiting device 100. The axial limiting device 100 is disposed in the sheath 500. One side of the axial limiting device 100 is limited to the bottom plate of the washing machine, and the other side acting on the flexible body assembly 200 is used to limit the axial movement of the flexible body assembly.

In the present embodiment, the axial movement of the flexible body assembly 200 is limited by the axial limiting device, thereby ensuring the stable operation of the flexible body assembly 200.

As a preferred embodiment of the present embodiment, the axial limiting device is an annular clamping spring 101 having a gap. The inner wall of the sheath 500 is provided with an annular groove 505, and the clamping spring 101 is snapped in the annular groove 505 and is located on the limiting plate 210 of the flexible body assembly 200. The installation and removal of the clamping spring 101 is simple and convenient, and the cost is low. The annular groove 505 is disposed in the inner wall of the sheath 500 to effectively limit the clamping spring 101 and ensure the stability of the installation of the clamping spring 101.

In the present embodiment, the annular groove 505 is provided in the inner circumferential wall of the sheath 500, which may be stamped, and preferably, the annular groove 505 is machined. After the limiting plate 210 is mounted to the sheath 500, the upper part of the clamping spring 101 is installed. After the clamping spring 101 is installed, the upper and lower ends of the limiting plate 210 cannot move.

Further, in the present embodiment, the upper surface of the clamping spring 101 is protruding provided with a limiting protrusion 102, and the limiting protrusion 102 further plays an axial limiting role when the clamping spring 100 axially moves. The clamping spring 101 has a limiting protrusion 102 for uniformly bearing force.

Further, a hole 103 for tool operation is disposed on the clamping spring 101 in this embodiment. The hole 103 in the clamping spring 101 facilitates tool installation.

The oil bag 250 described in this embodiment includes a telescopic corrugation structure 253, a throttling fine diameter part 252, and an opening 251. The throttling fine diameter part 252 communicates with the corrugated structure 253, and the opening 251 is located at the end part of the throttling fine diameter part 252.

The flexible body assembly 200 further includes an upper protection ring 240. A center of the upper protection ring 240 has a mounting hole 241 for the throttling fine diameter part 252 passing through. The upper protection ring 240 is provided with a mounting groove 242. An opening in one end of the mounting groove 242 is penetrated to the mounting hole 241 and an opening in the other end is opened on the side wall of the upper protection ring 240.

The throttling fine diameter part 252 enters into the mounting hole 241 through the mounting groove 242.

The lower surface of the upper protection ring 240 has a mating surface matched with the oil bag 250 to prevent the oil bag 250 from being damaged by pressing upwards under high pressure.

The upper protection ring 240 has a mounting hole 241 in the middle thereof, and has a mounting groove 242 structure. The outside of the mounting groove 242 has a chamfering structure 243, so that the throttling fine diameter part 252 of the oil bag 250 can be more easily installed in the mounting hole 241 of the upper protection ring.

The mounting hole 241 can ensure the strength at the throttling fine diameter part 252, avoid damage, prevent deformation here, and ensure that the throttling fine diameter part 252 of the oil bag 250 is always open, so as to ensure the working efficiency of the support for washing machine.

The contact portion of the upper protection ring and the oil bag conforms to the shape of the oil bag.

The upper protection ring and the hollow cavity structure of the regulating mechanism form a relatively sealed space. The inner placed oil bag is protected by these two components, which effectively prevents the oil bag from expanding, breaking, or damaging.

When the regulating mechanism is stressed, the regulating mechanism moves upwards, squeezes the oil bag and the internal hydraulic medium, and then transmits the force to the upper protection ring. However, the upper part of the upper protection ring is the pressing plate, the hydraulic plate or even the bottom plate of the washing machine, so that the upper protection ring cannot move upwards, and then is pressed into the regulating mechanism and squeezes out the hydraulic medium.

The upper protection ring and the pressing plate are not integrally fixed, so that the self-adjustment of the upper protection ring is facilitated. It is because of the unevenness of the force applied to the bottom of the regulating mechanism, the regulating mechanism can be slightly deflected although limiting structures are arranged. So that the upper protection ring can be slightly deflected. The circumference surface of the upper protection ring is concentric with the inner circumference surface of the regulating mechanism, and then the upper protection ring is pressed into the regulating mechanism.

The oil bag 250 has an opening 251, a throttling fine diameter part 252, and a corrugation structure 253, and the hydraulic medium is contained inside. Preferably, the hydraulic medium is a hydraulic oil.

The material of the oil bag 250 is an oil-resistant elastomer material such as nitrile rubber, acrylate rubber, silica gel, etc.

Since the oil bag 250 is in an up and down compression stretched working state, the body of the oil bag 250 is arranged in a corrugation structure 253 in order to improve its reliability and lifespan.

The oil bag 250 and the regulating mechanism 300, the oil bag 250 and the upper protection ring 240 are both in contact with each other, and there is only a certain gap at the position of the corrugation structure 253.

According to the support for washing machine in the present embodiment, that the flexible body assembly 200 is limitedly mounted is mainly to avoid the instability caused by the rotation of the support for washing machine during the automatic leveling process. Therefore, further, the support for washing machine in this embodiment also limits the movement of the regulating mechanism so that it only moves up and down without rotation, so as to ensure the stability of the leveling process, specifically:

In the inner wall of the sheath 500 of the present embodiment, a guiding limiting groove 501 is provided. The outer wall of the regulating mechanism 300 is provided with a guiding limiting block 302, and the guiding limiting block 302 is limited in the guiding limiting groove 501 and slides along its axis.

The sheath 500 has the guiding limiting groove 501 so that the regulating mechanism 300 can only move up and down within the sheath 500, and cannot rotate in a circle, so that the regulating mechanism 300 is prevented from rotating within the sheath 500. A very bottom of the guiding limiting groove 501 is provided with a stopping part 507 which cooperates with the limiting block 302 protruding around the circumference of the regulating mechanism 300 to prevent the regulating mechanism 300 from falling off from the sheath 500.

In the present embodiment, an elastic gasket 400 is disposed on the outer side of the bottom wall of the sheath 500. A reinforcing fitting groove is disposed on the bottom wall of the sheath 500. A reinforcing fitting rib 401 is disposed on the upper surface of the elastic gasket 400 to cooperate with the reinforcing fitting groove, and the lower surface of the elastic gasket 400 is partially recessed to form a damping rib 402.

Preferably, the elastic gasket 400 is a rubber gasket. A reinforcing fitting groove is arranged at the bottom of the regulating mechanism 300 to increase the connection strength between the regulating mechanism 300 and the rubber gasket, and the rubber gasket is provided with the reinforcing fitting rib 401. Preferably, the rubber is integrally injecting molded on the regulating mechanism 300. The place where the rubber gasket is in contact with the ground is preferably provided with some recessed patterns to form a damping rib 401, which increases the frictional resistance between the support and the ground, and prevents the washing machine from shifting due to vibration.

The embodiment also relates to a method for assembling a support for washing machine:

Based on sheath 500.

(1) Inserting the regulating mechanism 300 with a rubber gasket from the upper end opening of the sheath 500.

Note that the guiding limiting block 302 of the regulating mechanism 300 and the guiding limiting groove 501 of the sheath 500 must cooperate.

(2) Mounting the throttling fine diameter part 252 of the oil bag 250 into the upper protection ring 240. Inserting the opening of the oil bag 250 to the protruding part of the hydraulic plate 220 and putting the opening to the sealing groove 223. Pressing the pressing plate 230 to the opening of the oil bag 250. Mounting the oil bag 250, the upper protection ring 240, the pressing plate 230, the hydraulic plate 220 and the limiting plate 210 together to form the flexible body assembly 200, by penetrating crews or bolts through the limiting plate mounting hole 212, the hydraulic plate mounting hole 222 and the pressing plate mounting hole 231. Putting the flexible body assembly 200 inside the hollow cavity 301 of the regulating mechanism 300.

(3) Mounting the limiting plate 210 of the flexible body assembly 200 in the sheath 500. Limiting the lower part of the limiting plate 210 with the limiting groove 502 and limiting the circumferential direction of the limiting plate 210 with the limiting claw 211 and the limiting groove 502.

(4) Placing the clamping spring 101 in the annular groove 505 of the sheath 500. The flexible body assembly 200 no longer moves relative to the sheath 500 in the up and down direction and the circumferential direction, and is fixed together.

Assembly is completed, assembly efficiency is high, simple and convenient, and the force components are all made of sheet metal, with high reliability.

Embodiment II

As shown in Figs from 1 to 11, the support for washing machine with automatic leveling function in the present embodiment comprises:

a sheath 500;

a regulating mechanism 300, which is arranged in the sheath 500 and is axially movable relative to the sheath; and a flexible body assembly 200, which is arranged in the regulating mechanism 300 and accommodates a hydraulic medium;

one end of the flexible body assembly 200 is limited and arranged in the sheath 500, another end is a stretchable end which acts on the regulating mechanism 300; the stretchable end expands and contracts under the action of the hydraulic medium and drives the regulating mechanism to move axially for automatic leveling.

The flexible body assembly 200 includes a flexible accommodating body, a mounting assembly for mounting the flexible accommodating body, and a protection mechanism disposed between the mounting assembly and the flexible accommodating body for protecting the flexible accommodating body.

The flexible accommodating body of this embodiment is generally made of a flexible material, and the structure of the mounting assembly is generally and relatively rigid. The flexible accommodating body is mounted on the mounting assembly. If the two are in direct contact with each other, the mounting assembly may cause damage to the flexible accommodating body, in that case, the support for washing machine in this embodiment will not work.

In the present embodiment, in order to protect the flexible accommodating body, a protection mechanism is provided between the mounting assembly and the flexible accommodating body to prevent the flexible accommodating body from directly contacting the mounting assembly, thereby reducing the probability of breakage.

In order to achieve the protective effect of the protection mechanism on the flexible accommodating body, the protection mechanism of this embodiment should be made of a flexible material and/or have a curved surface that fits with the flexible accommodating body. In this way, the flexible accommodating body can be effectively buffered to avoid damage.

Preferably, the protection mechanism of this embodiment may be made of flexible material such as rubber material.

Further, the flexible accommodating body according to the present embodiment includes a telescopic corrugation structure 253, a throttling fine diameter part 252, and an opening 251. The opening 251 is sealed and installed on the mounting assembly. The protection mechanism is an upper protection ring 240, and the upper protection ring 240 is sleeved on the throttling fine diameter part 252. The upper end surface of the upper protection ring 240 is limited below the mounting assembly, and the lower end surface has a curved surface matched with the corrugation structure 253.

According to the structural features of the flexible accommodating body, the present embodiment adopts the upper protection ring 240 as the flexible accommodating body, and the curved surface on the upper protection ring can be matched with the corrugation structure 253 so that the upper end surface of the corrugation structure is fitted to the curved surface of the upper protection ring. In the above, the upper end surface of the corrugation structure is subjected to uniform force to avoid damage due to local stress concentration.

Specifically, the upper protection ring 240 in this embodiment includes an ring-shaped annular body and a mounting hole 241 at center part of the annular body for the throttling fine diameter part 252 going through. The annular body is provided with a mounting groove 242 which cuts through to the mounting hole 241, and the width of the mounting groove 242 is smaller than the outer diameter of the throttling fine diameter part 252. The throttling fine diameter part 251 enters into the mounting hole 241 through the mounting groove 242 after it is compressed and deformed.

The mounting groove 242 provided in the upper protection ring 240 of the present embodiment facilitates the mounting of the flexible accommodating body, and at the same time, the flexible accommodating body can be limited within the mounting hole 241 after installation.

Further, in this embodiment, the chamfering structure 243 is disposed at the opening of the mounting groove 242 toward the outside of the annular body, and the flexible accommodating body is more easily accessible into the mounting groove 242 and enters into the mounting hole 241 through it.

According to the support for washing machine with automatic leveling function of the present embodiment, the flexible accommodating body is protected by providing a protection mechanism between the mounting assembly and the flexible accommodating body, and further limiting the installation of the upper protection ring. The upper protection ring 240 is provided with a limiting hole 244 that penetrates up and down, and the mounting assembly is provided with a limiting protrusion 235 for engaging with the limiting hole 244. In this way, the mounting assembly of this embodiment is fixedly installed in the regulating mechanism 300 or fixedly installed on the bottom plate of the washing machine. The mounting assembly also achieves the circumferential limit of the upper protection ring 240 through the cooperation of the limiting protrusion 235 and the limiting hole 244 of the upper protection ring 240, avoiding the mutual rotation between the upper protection ring 240 and the flexible accommodating body and avoiding causing wear.

Further, the mounting assembly of the present embodiment is provided with a limiting column 234, and the limiting column 234 is disposed corresponding to the mounting groove 242 of the upper protection ring 240. The upper protection ring 240 is further limited by the limiting column 234, and because the limiting column 234 is disposed corresponding to the mounting groove 242, no additional limiting hole is needed on the upper protection ring 240.

Specifically, the mounting assembly described in this embodiment includes a hydraulic plate 220 and a pressing plate 230. The opening of the flexible accommodating body is sealed and connected to the lower wall of the hydraulic plate 220 through the pressing plate 230. An oil nozzle 221 is provided on one side of the hydraulic plate 220, a lower wall of the hydraulic plate 220 is provided with an oil hole 224 for the inflow of the hydraulic medium in the oil bag 250, and an oil passage 226 for communicating the oil nozzle 221 and the oil hole 224 is provided in the hydraulic plate 220. The lower end surface of the pressing plate 230 abuts against the upper end surface of the protection mechanism. The pressing plate 230 achieves the limitation of the upper protection ring 240 in the vertical direction.

The limiting protrusion 235 described in this embodiment is disposed on the lower end surface of the pressing plate 230.

Further, the limiting column 234 is disposed on the lower end surface of the pressure plate 230 and is located at both ends of the same diameter with the limiting protrusion 235.

Embodiment III

The present embodiment also provides a washing machine having the above-mentioned support for washing machine with automatic leveling function, including a shell, a plurality of said supports for washing machine are installed at the bottom of the shell, and the hydraulic medium filled in the supports for washing machine can circulated between the supports for washing machine to achieve leveling.

The factory setting of the washing machine of the embodiment is preferably that heights of four supports for washing machine are the same. The washing machine is randomly placed on an uneven ground and the four supports for washing machine bear different pressures according to the uneven states and the lengths of which regulating mechanisms are pressed into the sheaths are different, and then the automatic leveling of the washing machine is realized.

Further illustrations which are necessary for the above embodiments are:

1. Every two of the supports of the embodiments of the present disclosure are communicated. It can be three or more and the number $N \geq 2$, preferably two. It costs the lowest and can achieve better results.

Four end openings of the communicating device 15 are applied to be respectively connected with four supports. It is reasonable that three, five, six or N end openings of the communicating device 15 are applied, and the end openings are respectively connected with three, five, six or N supports. The above-described embodiments apply four supports which is the most suitable merely in the situation of being capable of achieving the described functions, to control the cost to the minimum.

2. The embodiments of the present disclosure take a drum washing machine as an example to describe the principle and the method of the automatic leveling of the drum washing machine. What is easy to associate with is that the present disclosure can be applied to a pulsator washing machine.

3. The embodiments of the present disclosure take a washing machine as an example to describe the principle and the method of the automatic leveling of the washing machine. What is easy to associate with is that the present disclosure can be applied to refrigerators, freezers, dishwashers, and other household appliances.

Figure 12:
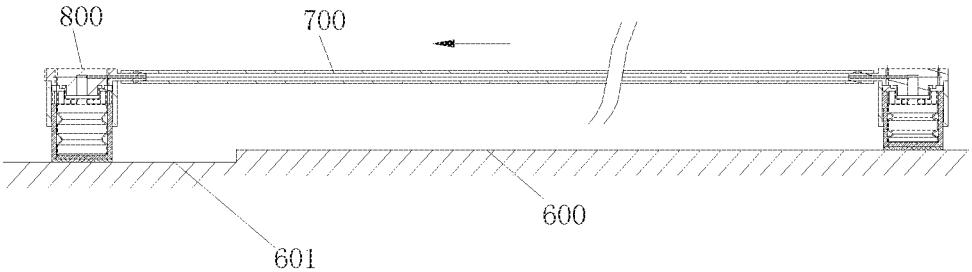
FIG. 12 is a leveling schematic diagram of the support for washing machine with automatic leveling function in an embodiment of the present disclosure.

As shown in FIG. 12, specifically speaking about the principle of leveling. When the washing machine is installed, due to the unevenness of the ground 600, the horizontal heights of the different supports for washing machine 800 are different, and the position of the supports for washing machine 800 at the ground pit 601 is lower. From this, it can be known that, the support for washing machine 800 at a high position first bears the weight of the washing machine, and the weight that it bears is large, and the support for washing machine 800 at a low position has a failure of support problem or bears small weight.

The regulating mechanism 300 of the support for washing machine 800 at a high position will move upward under a large pressure, and the height of the entire support will become smaller, so that the volume of the hollow cavity of the oil bag 250 filled with hydraulic oil will be reduced, and the hydraulic oil will be forced into a throttling hole or a valve hole and flows into supports at a low position through the high-pressure oil pipe 700. Thus, the hydraulic oil in the oil bag 250 of the support at the lower position is more and more, so that the oil bag 250 expands to push the regulating mechanism 300 to elongate.

When the hydraulic pressures of the supports at the high position and the low position are the same, the hydraulic oil no longer flows through the high pressure oil pipe 700, and the relative position between the regulating mechanism and the bottom plate of the washing machine no longer changes, and the automatic adjustment of the supports for washing machine is completed.

During the washing or spin-drying process of the washing machine, the vibration noise of the washing machine is greatly reduced because the hydraulic oil can also slowly flow to automatic level.

The high-pressure oil pipe 700 of the embodiment of the present disclosure is connected to the oil nozzle 221 of the support for washing machine 800.

The above-mentioned embodiments are only preferred embodiments of the present disclosure, but not intended to limit the present disclosure in any form. Although the present disclosure has been described in terms of preferred embodiments, it is not intended to be limited to these disclosed embodiments. Equivalent embodiments, of which some changes or modifications are equivalent changes, may be made by any skilled in the art by using the above-mentioned technical contents without departing from the technical scheme scope of the present disclosure. However, all simple amendments, equivalent changes and modifications made to the above embodiments according to the technical essence of the present disclosure without departing from the technical scheme scope of the present disclosure all still fall within the protection scope of the present disclosure.

The invention claimed is:

1. A support for a washing machine with automatic leveling function comprising a sheath;

a regulating mechanism being arranged in the sheath and axially movable relative to the sheath; and a flexible body assembly being arranged in the regulating mechanism and accommodating a hydraulic medium; wherein one end of the flexible body assembly is limited and arranged in the sheath, another end is a stretchable end which acts on the regulating mechanism, the stretchable end expands and contracts under an action of the hydraulic medium and drives the regulating mechanism to move axially for automatic leveling;

the flexible body assembly comprises a flexible accommodating body, a mounting assembly for mounting the flexible accommodating body, and a protection mechanism provided between the mounting assembly and the flexible accommodating body for protecting the flexible accommodating body, the flexible accommodating body comprises a telescopic corrugation structure, a throttling fine diameter part and an opening, and the opening is mounted on the mounting assembly in a sealed manner;

the protection mechanism is an upper protection ring and the upper protection ring sleeves on the throttling fine diameter part, an upper end surface of the upper protection ring is configured for limited movement below the mounting assembly, a lower end surface is provided with a curved surface matched with the corrugation structure.

2. The support for the washing machine with automatic leveling function according to claim 1, wherein the upper protection ring comprises an annular body and a mounting hole at a center of the annular body for the throttling fine diameter part going through;

the annular body is provided with a mounting groove cutting through the mounting hole, a width of the mounting groove is smaller than an outer diameter of the throttling fine diameter part;

the throttling fine diameter part deforms under pressure, and then enters the mounting hole through the mounting groove.

3. The support for the washing machine with automatic leveling function according to claim 2, wherein a chamfering structure is provided at a cap, facing outside of the annular body, of the mounting groove.

4. The support for the washing machine with automatic leveling function according to claim 1, wherein a limiting hole which goes up and down is formed in the upper protection ring, and a limiting protrusion used for being matched with the limiting hole is arranged on the mounting assembly.

5. The support for the washing machine with automatic leveling function according to a claim 1, wherein a limiting column is arranged on the mounting assembly, and the limiting column is arranged corresponding to a mounting groove of the upper protection ring.

6. The support for the washing machine with automatic leveling function according to claim 1, wherein the mounting assembly comprises a hydraulic plate and a pressing plate, an opening of the flexible accommodating body is hermetically connected to a lower wall of the hydraulic plate through the pressing plate;

an oil nozzle is arranged on one side of the hydraulic plate, an oil hole used for enabling the hydraulic medium in an oil bag to flow into is formed in the lower wall of the hydraulic plate, an oil passage for allowing the oil nozzle to communicate with the oil hole is arranged in the hydraulic plate;

a lower end surface of the pressing plate abuts against an upper end surface of the protection mechanism.

7. The support for the washing machine with automatic leveling function according to claim 6, wherein a limiting protrusion is provided on the lower end surface of the pressing plate.

8. The support for the washing machine with automatic leveling function according to claim 7, wherein a limiting column is provided on the lower end surface of the pressing plate, and the limiting column and the limiting protrusion are located at two ends of a same diameter.

9. A washing machine comprising a plurality of supports with automatic leveling function according to claim 1, comprising a shell, and the plurality of supports being mounted on a bottom of the shell, wherein the hydraulic medium provided in the supports of the washing machine flows between the plurality of supports for leveling.

10. The support for the washing machine with automatic leveling function according to claim 2, wherein a limiting hole which goes up and down is formed in the upper protection ring, and a limiting protrusion used for being matched with the limiting hole is arranged on the mounting assembly.

11. The support for the washing machine with automatic leveling function according to a claim 2, wherein a limiting column is arranged on the mounting assembly, and the limiting column is arranged corresponding to the mounting groove of the upper protection ring.

12. The support for the washing machine with automatic leveling function according to claim 2, wherein the mounting assembly comprises a hydraulic plate and a pressing plate, an opening of the flexible accommodating body is hermetically connected to a lower wall of the hydraulic plate through the pressing plate;

an oil nozzle is arranged on one side of the hydraulic plate, an oil hole used for enabling the hydraulic medium in an oil bag to flow into is formed in the lower wall of the hydraulic plate, an oil passage for allowing the oil nozzle to communicate with the oil hole is arranged in the hydraulic plate;

a lower end surface of the pressing plate abuts against an upper end surface of the protection mechanism.

* * * * *